US006482242B2

(12) United States Patent
Yarmosky

(10) Patent No.: US 6,482,242 B2
(45) Date of Patent: Nov. 19, 2002

(54) PRESSURE PRETREATING OF STAINS ON FABRICS

(76) Inventor: Steven E. Yarmosky, RR 3 View Dr., Richmond, MA (US) 01201

( * ) Notice: Subject to any disclaimer, the term of this patent is extended or adjusted under 35 U.S.C. 154(b) by 0 days.

(21) Appl. No.: 09/884,571

(22) Filed: Jun. 19, 2001

(65) Prior Publication Data

US 2001/0049847 A1 Dec. 13, 2001

Related U.S. Application Data

(63) Continuation of application No. 09/177,333, filed on Oct. 22, 1998, now Pat. No. 6,263,708.

(51) Int. Cl.[7] ..... D06F 29/00

(52) U.S. Cl. ..... 8/149.1; 8/158; 68/5 A; 68/183; 68/207; 68/17 R

(58) Field of Search ..... 68/5 A, 183, 207, 68/17 R, 290; 8/149.1, 149.2, 158

(56) References Cited

U.S. PATENT DOCUMENTS

| | | | |
|---|---|---|---|
| 2,254,691 A | | 9/1941 | Mac Elland, Jr. |
| 2,437,478 A | | 3/1948 | Pickett, Jr. et al. |
| 2,619,821 A | | 12/1952 | Fink |
| 3,320,780 A | * | 5/1967 | Frahm |
| 3,500,666 A | | 3/1970 | Calcaterra |
| 3,611,456 A | | 10/1971 | Hildebrandt |
| 3,619,830 A | | 11/1971 | Harris et al. |
| 3,687,729 A | | 8/1972 | Winburn et al. |
| 3,760,612 A | | 9/1973 | Bochan et al. |
| 3,805,562 A | | 4/1974 | Waugh et al. |
| 3,942,341 A | | 3/1976 | Sang |
| 3,974,667 A | | 8/1976 | Gakhar |
| 3,990,272 A | | 11/1976 | Gakhar |
| 4,111,011 A | | 9/1978 | Waugh |
| 4,120,180 A | | 10/1978 | Jedora |
| 4,134,277 A | | 1/1979 | Platt et al. |
| 4,149,393 A | | 4/1979 | Uhlyarik |
| 4,417,457 A | | 11/1983 | Brenner |
| 4,467,627 A | | 8/1984 | Platt et al. |
| 4,478,059 A | | 10/1984 | Yates |
| 4,503,575 A | | 3/1985 | Knoop et al. |
| 4,889,644 A | | 12/1989 | Amberg et al. |
| 4,926,514 A | | 5/1990 | Leuenberger |
| 5,074,132 A | | 12/1991 | Koller |
| 5,253,378 A | | 10/1993 | Jung, Jr. |
| 5,359,744 A | | 11/1994 | Kimball et al. |
| 5,381,574 A | | 1/1995 | VonPless |
| 5,402,657 A | | 4/1995 | Henry, Jr. |
| 5,565,422 A | | 10/1996 | Del Greco et al. |
| 5,617,746 A | | 4/1997 | Hong et al. |

FOREIGN PATENT DOCUMENTS

| | | |
|---|---|---|
| GB | 460711 | 2/1937 |

* cited by examiner

*Primary Examiner*—Frankie L. Stinson
(74) *Attorney, Agent, or Firm*—Hedman & Costigan, P.C.

(57) ABSTRACT

A pressurized pretreatment process for removal of stains on fabrics prior to washing employing means for delivering a stain pretreating solution under the pressure of water or air or a combination of water and air. Stains are effectively removed on such fabrics as polyester/cotton blends and cotton, and a washing machine having delivery means for delivering a stain pretreating solution under pressure.

12 Claims, 4 Drawing Sheets

PRESSURE PRETREATING OF STAINS ON FABRICS

REFERENCE TO RELATED APPLICATIONS

The present application is a continuation of Ser. No. 09/177,333, filed on Oct. 22, 1998, now U.S. Pat. No. 6,263,708.

FIELD OF THE INVENTION

This invention relates to a process for pressure pretreating of stains on fabrics prior to washing, preferably prior to washing in an automatic washer. The process of this invention employs water pressure or air pressure or both in combination with a stain treating solution to pretreat stains on fabrics. The stain treating solution may be a liquid detergent or a liquid formulated for treating stains.

Also, this invention relates to an automatic washing machine having means for delivering a stain treating solution under pressure to stained fabrics.

BACKGROUND OF THE INVENTION

Recent automatic clothes washing machines customarily proceed through a sequence of operations or cycles in order to wash, rinse and spin dry clothes. The sequence ordinarily includes a prewash, a first liquid removal operation, a wash operation, a second liquid removal operation, a rinse operation, and a final liquid removal operation.

In order to obtain the desirable results form these machines, it has been found advantageous to introduce certain additives into the water or washing cycle that is employed. A pre-wash additive may be added in the soak operation; a soap or detergent is normally used in the washing operation and a bleach may also used in this operation, while rinse agents are added to the rinse water.

In an automatic washing machine, it is desirable that these additives be dispensed automatically. When the dispensing of additives is automatic, the user may load the fabrics to be washed into the wash tub and place the additives into their proper compartments or containers, and the machine automatically completes the cycle of operations. Also, the best results are obtained if these various additives are dispensed with water so that additives are metered in to the wash tub and evenly distributed rather than being concentrated into a few of the articles.

A number of different types of dispensers for liquids in automated washing devices have been used heretofore. Among these are such differing approaches as electromechanical devices which require programmed remote actuation, as well as a number of what are essentially self-actuated devices of a primarily mechanical nature which respond to various conditions during the operation of the washing machine, often a predetermined agitator speed threshold, to dispense liquids at some given point during the washing process without the need for external control devices.

Even though there is disclosed in the art the dispensing of various additives into the washing machine, the pressure pretreating of stains on fabrics has not been fully appreciated. While stain removal additives are available in the market place which may be added in a particular cycle during washing or the stain may be pretreated by hand with a stain remover solution purchased off the shelf, some stains are not completely removed by such methods as for example: mud, grease, coffee, oils, grass, etc. stains.

Therefore, it is an object of this invention to provide means for pretreating stains on fabrics prior to washing.

It is another object of this invention to provide means for pressure pretreating of stains on fabrics prior to washing.

Yet another object of this invention is to provide means for pressure pretreating of stains on fabrics utilizing the pressure of water, air or a combination of both.

The foregoing and other objects of this invention will be apparent from the following description of this invention and appended claims.

SUMMARY OF THE INVENTION

The instant invention is directed to a process of pressure pretreating stains on fabrics prior to washing, preferably prior to washing in an automatic washing machine. This invention also provides means for delivery of a stain pretreating solution under the pressure of water, air or a combination of water and air pressure. The stain pretreating solution may be delivered concentrated or diluted, and may be a liquid detergent or a liquid stain treating solution. While a solid detergent or solid stain treating material may be employed in the practice of this invention, it would need to be applied in solution form in order to provide a liquid solution for delivery to the stain.

Obviously, if the stain pretreating solution is delivered under water pressure, the stain pretreating solution will be diluted. It is necessary that in the practice of this invention, the delivery of the stain pretreating solution be under pressure.

As used herein, stain treating solution shall mean liquid stain treating solution or solid stain treating material in solution.

DETAILED DESCRIPTION OF THE INVENTION

Figure 1:
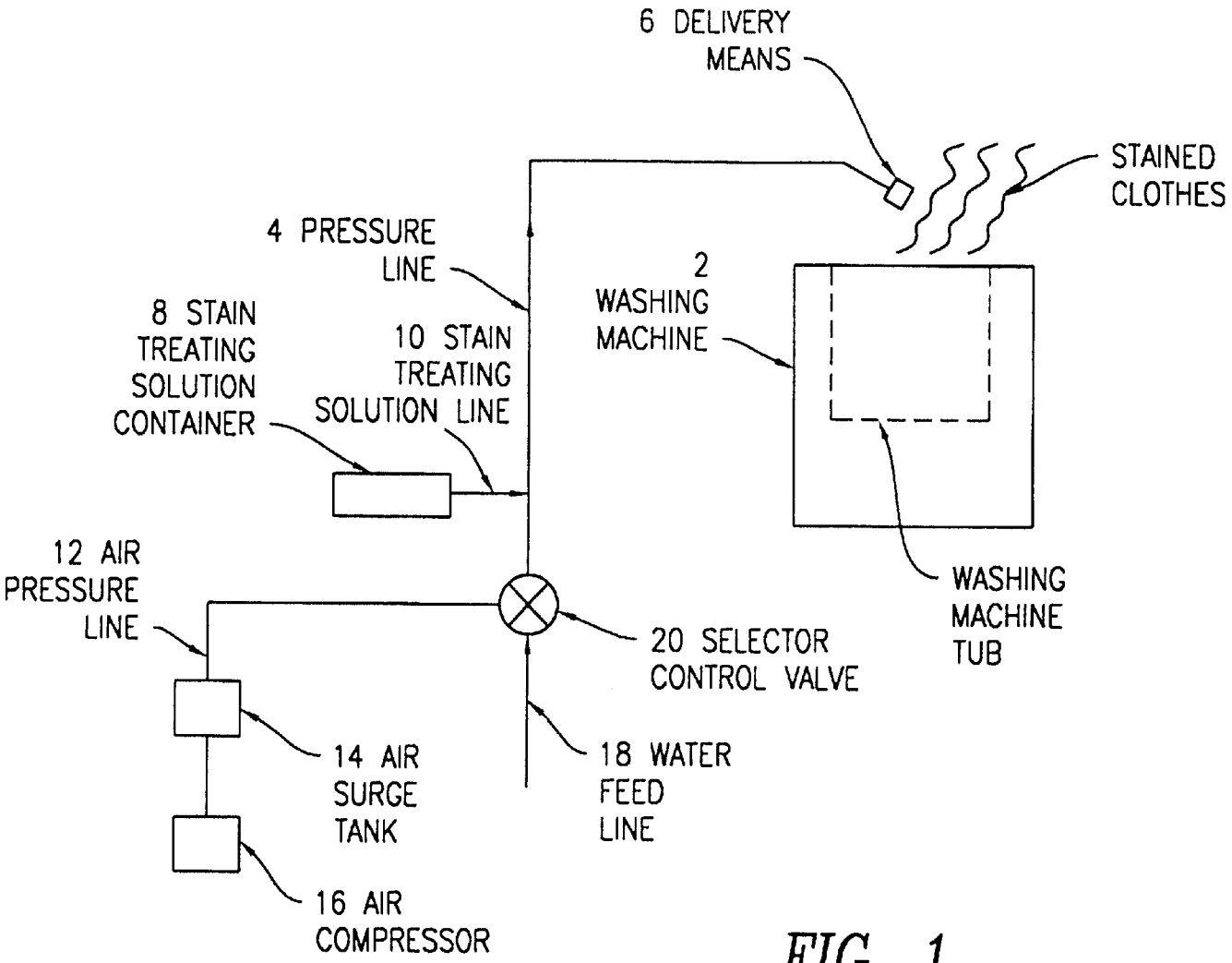
FIG. 1 is a flow diagram of one embodiment of this invention utilizing a single pressure line for delivery of stain treating solution under water and/or air pressure.

This invention is a pressure or power pretreatment of stains on fabrics prior to washing and is particularly adaptable to home washing machines but may also be adapted to commercial laundry washing machines. The process of this invention is directed to delivering a stain treating solution under pressure to the stain preferably delivery outside of a washing tub of an automatic home washing machines but prior to subjecting clothes to a washing cycle in such a washing machine and to means for delivering the stain treating solution under pressure. When applying the stain treating solution in an automatic washing machine, the washing tub may be utilized as a receptable and the lid of the washing machine when opened may be utilized as a back splash panel. The pressure employed may be ordinary household water pressure, or air pressure which may be provided by an air compressor or a combination of both water and air. The water pressure is generally household water pressure which may vary from about 45 –60 psig (pounds per square inch gauge) generally after being reduced through a reducing valve from city water pressure which may be in the 80 to 100 psig range. The water pressure may be higher or lower depending on the water pressure in the particular geographical area. The air pressure employed may be upwards of from about 10 to about 100 psig. The pressure may be provided by such means as an air compressor which may be conveniently included in an automatic washing machine compartment or may be installed adjacent to or near an automatic washing machine. To prevent an undesirable high or variable air pressure surge and to provide controlled air pressure, an air surge tank may be employed. The stain treating solution delivery to the stain through delivery means. It is preferable that the stain treating solution be delivered to the stain over the washing tub, but may also be applied away from the tub. Alternatively, in another embodiment, water in combination with air and stain treating solution may also be applied to the stain on the fabric. In conjunction with an air pressure line, an air pressure control valve such as a reducing valve and gauge may be employed with the air pressure line. It may also be convenient to employ a water pressure gauge with a reducing valve in conjunction with a water line to control the water pressure. Even when employing water or air separately, control valves as described above may be utilized.

In one embodiment of this invention the delivery of the stain treating solution under pressure may be by means of a nozzle with a pistol grip and trigger. This is somewhat similar to a garden hose nozzle or a dental 3-way syringe which can deliver air, water or both. Such 3-way dental syringe may be of the type manufactured by Riverstate Dental of Tualatin, Oreg. or A-dec of Newberg, Oreg.

A dual but separate water and air lines may be attached to such delivery means with valve means such as a diverter valve or selector means to direct either water or air separately to the delivery means or both water and air jointly to the delivery means. Also applicable for the delivery of the stain treating solution in combination with pressure is that means similar to the multi soda delivery device employed for dispensing one of several different liquid sodas or a combination of different liquid sodas such as employed at a soda fountain or tavern. This is sometimes referred to as a soda gun. Each particular soda has a separate line to the soda gun and the soda gun has a separate "button" for each soda. The soda, either premixed or post mixed, is delivered to the soda gun under pressure usually employing carbon dioxide ($CO_2$) which also adds effervescence to the soda. Post mixing is mixing soda syrup, water and $CO_2$ just prior to delivery through the soda gun. Premixing provides soda in premixed form with syrup and water, and $CO_2$ is employed to deliver the soda to the soda gun. When the "Button" is pressed, a valve opens and delivers the soda under pressure to a container for further consumption by the consumer.

In one embodiment of this invention, it may be desirable to employ means for delivering different stain treating solutions. As such, a similar mechanism as the soda gun may be employed for delivering different stain treating solutions or a combination of different stain treating solutions depending upon the stain to be treated. Since this may involve more than one stain treating solution container, it is preferable to utilize one stain treating solution container for a single treating solution. Even a blend of stain treating solutions may also be employed in a single stain treating solution container.

In the practice of this invention, the stain treating solution is drawn from a container holding the stain treating solution such as siphoning the stain treating solution from its container when activating the delivery means. The stain treating solution is siphoned from the stain treating holding container as water and/or air passes by the liquid stain treating feed container or feed line from the container. The stain treating holding container should preferably have an opening to the atmosphere such that there is atmospheric pressure on the surface of stain treating solution as the stain treating solution is withdrawn from the container. This avoids forming a low pressure (less than atmospheric pressure) on the surface of the stain treating solution in the container which would thus inhibit withdrawal of the stain treating solution. When shutting off the delivery means by releasing the activating device, shut off is preferably before the stain treating container to avoid a build up of back pressure of stain treating solution.

While not shown, another embodiment of this invention is that a small pump may be employed to pump or meter the stain treating solution to the delivery means for subsequent application to the stained fabric. Alternatively, air pressure from an air pressure line or surge tank may be jointly diverted to the surface of the stain treating solution in the container in order to expert pressure on the stain treating solution to feed such to the nozzle.

It has been surprisingly discovered that by treating stains on fabrics with a stain treating solution or detergent under pressure, stains are effectively removed or greatly diminished in visibility with essentially no damage to the fabric. This becomes increasingly more important in view of the blends of natural and synthetic fabrics. This invention is effective on petroleum stains such as grease, oil and the like, environmental stains such as grass, mud, dirt, shrubs and the like, and food stains such as tomato sauce, coffee ground, ketchup, wine, mustard and the like, and such other stains not covered by the above. Such stains appear to become embedded in the fibers of the fabric. Applying a stain treating solution or detergent under pressure directly to the stain as disclosed in this invention has been effective, convenient, time saving and not as messy compared in other stain treating methods. As can be appreciated, a stain is preferably removed during the first washing of the fabric, otherwise, the stain may become "heat set" after the first wash/drying and consequently becomes extremely more difficult to remove. However, in the practice of this invention, stains that are visibly diminished after one treatment and washing may be treated and washed a second or subsequent times to remove the stain.

The stain treating solution may be applied in an essentially concentrated form or may be metered at various dilutions, such as light, moderate or heavy concentration of the stain treating solution. A selection indicator and/or selector means may be employed for selection of a particular dilution. As increased dilution is wanted, the volume of stain treating solution may be reduced or the volume of water increased through utilizing a control value on either the stain treating solution line or the water line.

FIG. 1 is a flow diagram showing washing machine 2 employing a single pressure stain treating solution line 4 which connects to delivery means 6. Stain treating solution is siphoned from stain treating solution container 8 when delivery means 6 is activated drawing stain treating solution into feed line 10 from container 8 and into pressure line 4. Air pressure from air pressure feed line 12 delivers air to pressure line 4 utilizing air surge tank 14 when the air pressure diverter valve selector is opened. Air under pressure is delivered by an electric air compressor 16 to air surge tank 14. Water feed line 18 delivers water under pressure to pressure line 4. Selector control valve 20 can be employed to select air under pressure from air feed line 12 or to water through water feed line 18 or to deliver both water and air to pressure line 4.

Figure 2:
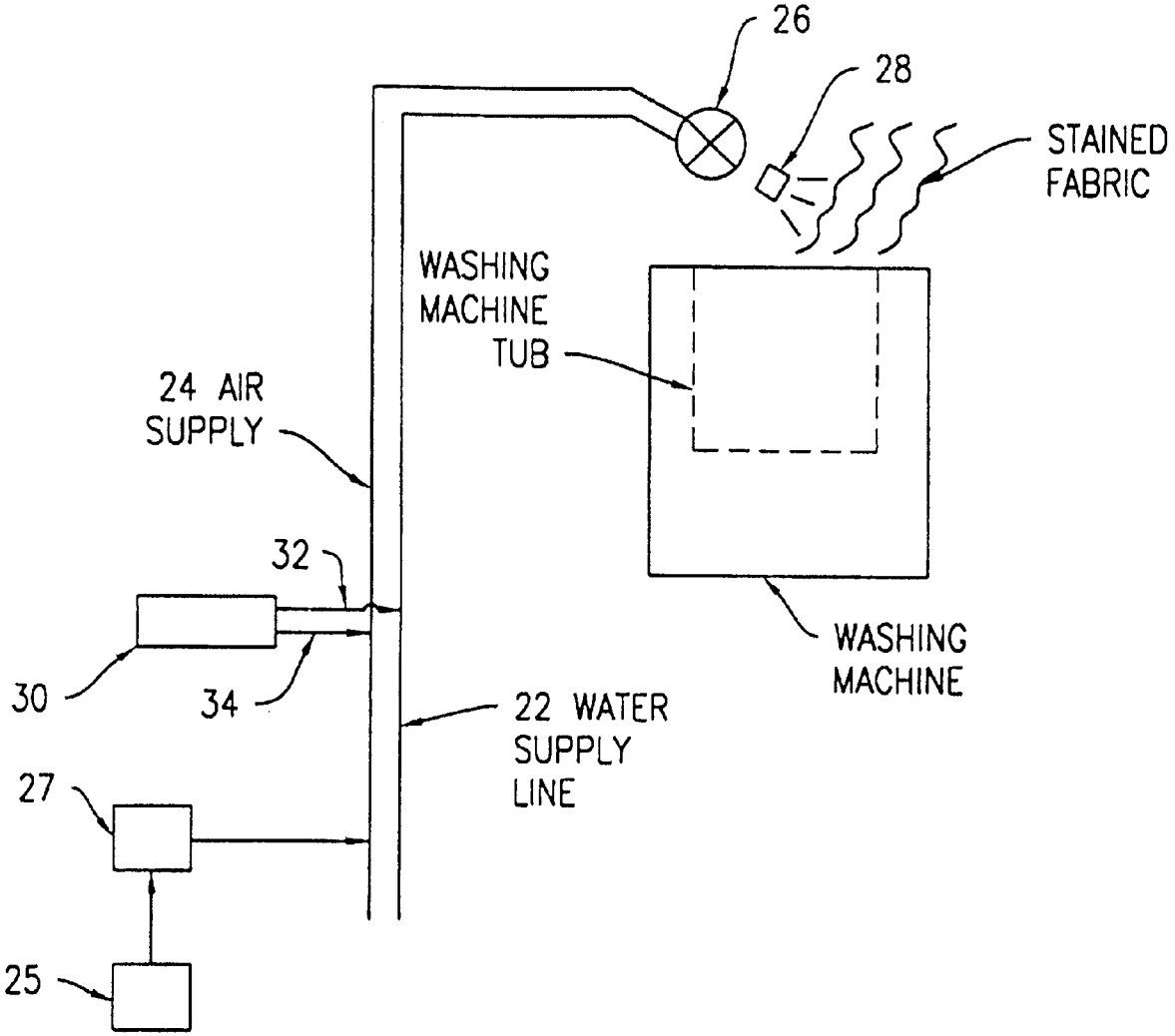
FIG. 2 is a flow diagram of another embodiment of this invention utilizing dual pressure lines, one with water and one with air for delivery of stain treating solution.

FIG. 2 is a flow diagram of another embodiment of this invention wherein two separate pressure lines are employed, line 22 for water and line 24 for air which lines are connected to selector valve 26 which valve 26 to attached to delivery means 28. Air is supplied from compressor 5 through surge tank 27. Delivery means 28 has means for activating valve 26 to provide delivery of either air pressure from air pressure line 24 or water from water pressure line 22 or a combination of both air pressure and water jointly from lines 22 and 24. When delivery means 28 is activated upon selection of either water, air, or both, stain treating solution is drawn from stain treating solution container 30 through stain treating solution line 32 or 34 depending upon which pressure tine is engaged. In the event a combination of both water and air pressure from air line 24 and water line 22 is wanted, stain treating solution is drawn through lines 32 and 34.

Figure 3:
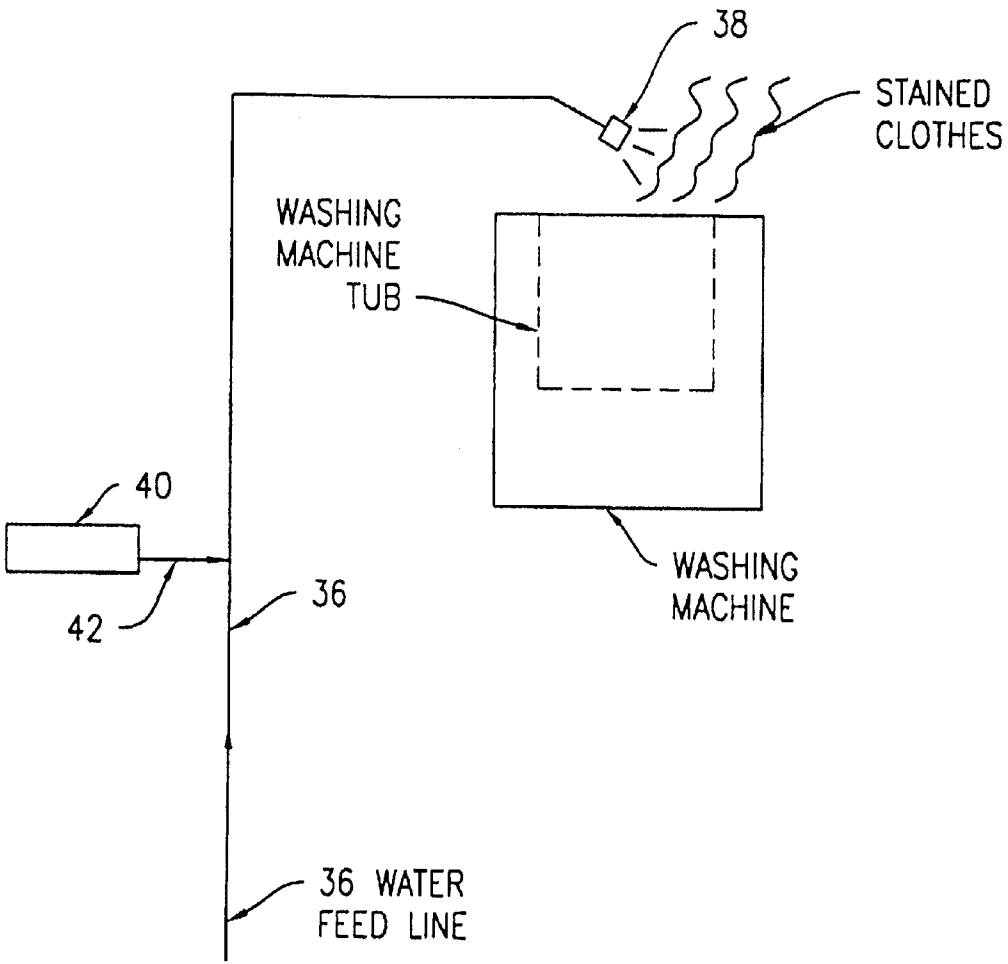
FIG. 3 is a flow diagram of yet another embodiment of this invention utilizing water pressure only for delivery of stain treating solution.

FIG. 3 is a flow diagram of another embodiment of this invention wherein a single water pressure line 36 is connected to delivery means 38 and stain treating solution is drawn from stain treating solution container 40 into solution line 42 and into water pressure line 36 for delivery to delivery means 38 when delivery means 38 is engaged.

Figure 4:
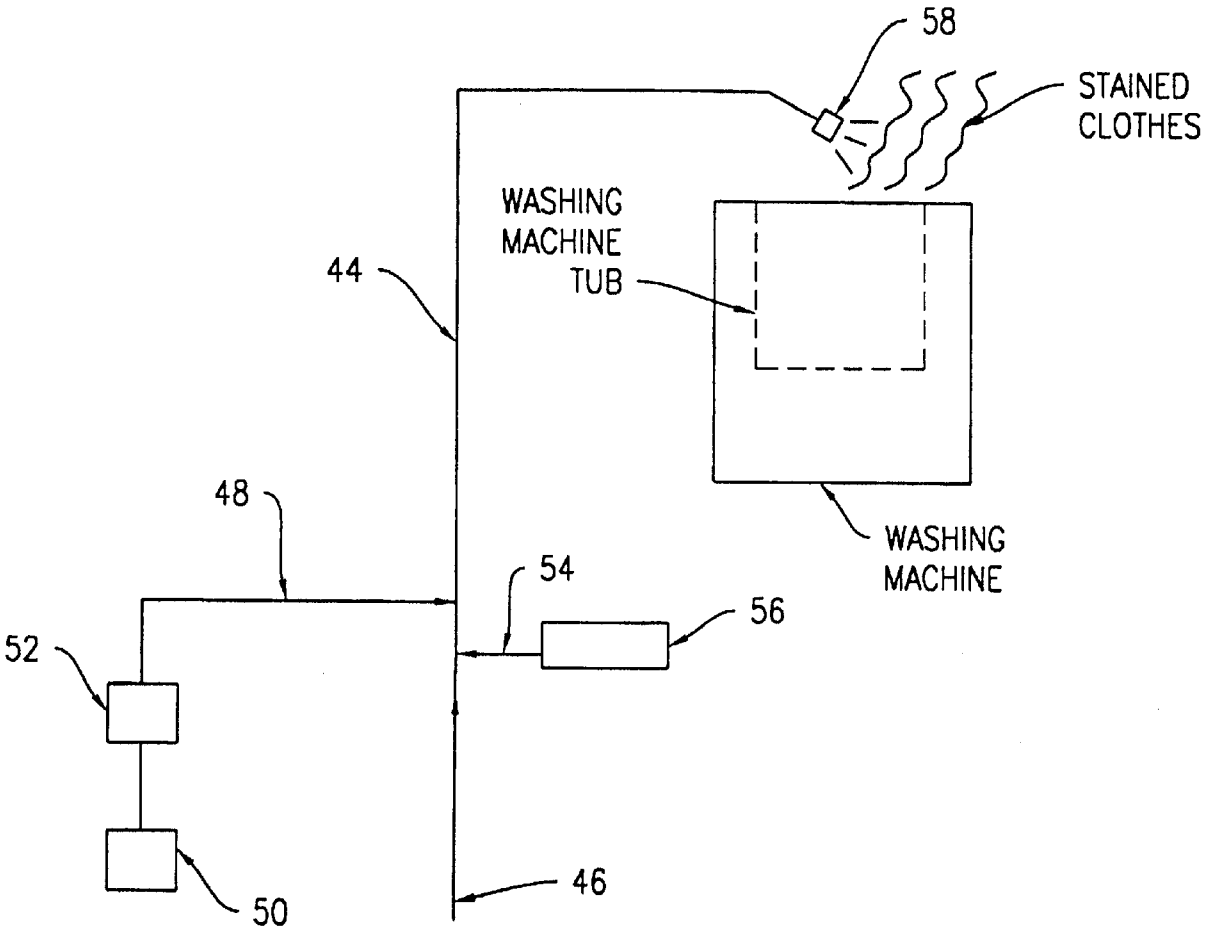
FIG. 4 is a flow diagram of still another embodiment of this invention showing a single pressure line for delivery of water, air and stain treating solution to the stained fabric.

FIG. 4 is a flow diagram of still another embodiment of this invention wherein a single pressure line 44 into which water through water feed line 46 and air through air feed line 48 is fed. Air from air compressor 50 is fed through air surge tank 52 into air feed line 48. Water through water feed line 46 draws stain treating solution through stain treating solution feed line 54 from stain treating solution container 56. The combination of water, air and stain treating solution is sprayed under water and air pressure onto stained fabric upon activating nozzle 58.

While FIGS. 1, 2, 3, and 4 are flow diagrams of several embodiments of this invention, any one of the pressure supply lines may be preset by a maker of a washing machine utilizing this invention with either water, air or a combination of air and water pressure without the need for selection by the consumer or user.

DETAILED DESCRIPTION OF THE EXAMPLES

The removal of stains from fabrics in the practice of this invention can be further exemplified by the following examples. It should be understood, however, that this invention shall in no way be restricted by these examples.

Example 1

A dental 3-way syringe with a trigger device capable of supplying water or air or both to the delivery end thereof manufactured by A-dec of Newberg, Oreg. was employed to apply the pressure of water and air directly onto stained fabric through the 3-way syringe after treating the stain with a stain treating solution. The water and air lines enter the syringe and are held under pressure until a push button valve for air and/or water is depressed to engage the valve for release of air and/or water. In this syringe, water and air is delivered to the terminal end or nozzle of the syringe upon depressing the push button for air and water. Water then travels out of a center channel and air out of an outer channel of the syringe. Air was at a pressure of about 80 pounds per square inch gauge (psig) and was provided by means of an air compressor. Water was regular city water which was at a delivery pressure of about 45 psig. Various stains on fabrics as set forth in TABLE 1 below were treated prior to washing with stain treating solutions of Spray and Wash™ liquid, Shout™ liquid, or Shout™ gel which are trademark stain treating solutions purchased off the shelf in a local market. The fabrics were divided into five vertical sections and marked as follows, with a permanent fabric marker.

A—Control, no stain treatment

B—Pressure pretreatment with stain treating solution by first applying the stain treating solution and then immediately pressure treating with an air/water combination from the dental syringe for about 10 to 15 seconds.

C—Same as B, but stain was scrubbed with a dental brush while pressure treating the stain with stain treating solution and an air/water combination.

D—Stain treating solution applied in accordance with directions on a label on a purchased stain remover.

E—Same as D, but stain treating solution applied with a brush provided with a stain treating solution.

Various types of stains were applied to the fabrics and were the type set forth in TABLE 1 below. After staining the fabrics, the fabrics were sun dried for about an hour. The fabrics were then treated with stain treating solution as described above in sections A–E. However, each vertical row was covered with clear contact paper which was subsequently removed to avoid contamination of a subsequent section during treating of a stained section. The stained and treated fabrics were kept in a plastic bag for about 45 minutes and then washed in an automatic washing machine, which was about a 20 minute cycle with a ½ cup of detergent (TIDE™) using warm/cold water selection. The washed fabric was then dried in a home dryer. The results are set forth in TABLE 1.

The fabrics employed in this Example 1 were 100% cotton and 65/35 blend of 65% polyester and 35% cotton. Stain removal was visually compared to the control sample. The results were rated in accordance with following rating:

1-stain removed, no visible sign of the stain.

2-stain substantially removed with little stain being visible.

3-stain partially removed with more stain being visible compared to stain rating 2.

4-essentially no effect on stain removal.

TABLE 1

| | A Control | | B Pressure Pretreating | | C Pressure Pretreating with a Brush | | D *Shout ™ | | E *Shout ™ With Brush | |
|---|---|---|---|---|---|---|---|---|---|---|
| Stain | 100% Cotton | 65/35 | 100% Cotton | 65/35 | 100% Cotton | 65/35 | 100% Cotton | 65/35 | 100% Cotton | 65/35 |
| French's mustard | 4 | 4 | 4 | 4 | 4 | 4 | 4 | 4 | 4 | 4 |

TABLE 1-continued

| | A Control | | B Pressure Pretreating | | C Pressure Pretreating with a Brush | | D *Shout ™ | | E *Shout ™ With Brush | |
|---|---|---|---|---|---|---|---|---|---|---|
| Stain | 100% Cotton | 65/35 | 100% Cotton | 65/35 | 100% Cotton | 65/35 | 100% Cotton | 65/35 | 100% Cotton | 65/35 |
| Tomato pasta sauce | 4 | — | 1 | — | 1 | — | 1 | — | 1 | — |
| Mud | 4 | — | 2 | — | 2 | — | 4 | — | 3 | — |
| Coffee grounds | 4 | 4 | 1 | 1 | 1 | 1 | 3 | 4 | 3 | 3 |
| Coffee | 1 | — | 1 | — | 1 | — | 1 | — | 1 | — |
| Grease | 4 | 4 | 1 | 1 | 1 | 1 | 4 | 4 | 3 | 3 |
| Grass stains | 4 | 4 | 2 | 3 | 1 | 2 | 4 | 4 | 3 | 3 |
| Ketchup | 1 | 1 | 1 | 1 | 1 | 1 | 1 | 1 | 1 | 1 |
| Garlic mustard | 1 | 1 | 1 | 1 | 1 | 1 | 1 | 1 | 1 | 1 |
| Sun dried tomato sauce | — | 1 | — | 1 | — | 1 | — | 1 | — | 1 |
| Hot pepper | — | 1 | — | 1 | — | 1 | — | 1 | — | 1 |
| Apple/ blueberry butter | — | 1 | — | 1 | — | 1 | — | 1 | — | 1 |
| Soy sauce | — | 1 | — | 1 | — | 1 | — | 1 | — | 1 |
| Vinegar/ oil | 1 | 1 | 1 | 1 | 1 | 1 | 1 | 1 | 1 | 1 |

*Shout ™ was applied according to directions on the label.

As shown in the results, stain removal was more effective when treating petroleum stains (grease), organic substance stains (grass), environmental stains (mud or dirt) and ground in food stains (coffee grounds) when employing the pressure pretreating of the stains in accordance with this invention.

In addition, note that the stain treating solution was left on the stained fabric (about 45 minutes) compared to normal use and directions which as stated on the label of stain treating solution Shout™ is to "wait 1–5 minutes depending on the severity of the stain" after applying the stain treating solution before washing. The label also states that "when treating set in or tough greasy stains . . . let set overnight or longer before washing". In actual practice, it is believed that most fabrics treated with a stain treating solution are immediately washed. On the other hand, it was also observed that when pressure treating stains with a stain treating solution, stain removal was essentially almost immediate. In actual practice where most stained fabrics are treated and immediately washed, the pressure treatment of stains with a stain treating solution would even be more effective.

While many modifications and variations of the present invention are possible in view of the foregoing specification, it is understood that they would fall within the scope of the appended claims.

What is claimed is:

1. A pressure stain treating process for pretreating a stain on a fabric which process comprises the steps of (1) selecting a stain treating solution for user selective formulation using a control means and applying said user selected stain treating solution to the fabric via a single delivery means regardless of the stain treating solution selected, (2) subjecting the stain treating solution to sufficient pressure to cause the stain treating solution to penetrate the stain and then (3) washing the treated stained fabric; and wherein said stain treating solution and pressure is applied external to a clothes washing container.

2. The process of claim 1 wherein said pressure is from water at a pressure of about 45 to about 65 psig.

3. The process of claim 1 wherein said pressure is from air at a pressure of about 10 to about 100 psig.

4. The process of claim 1 wherein said pressure is from a combination of water and air pressure.

5. The process of claim 1 wherein the stain treating solution is a liquid stain remover.

6. The process of claim 1 wherein the stain treating solution is a liquid detergent.

7. The process of claim 1 wherein an air compressor is employed to provide air pressure.

8. The process of claim 7 wherein an air surge tank is employed to provide air at a constant controlled pressure.

9. The process of claim 1 wherein said stain treating solution is applied to said stained fabric in combination with the pressure of water, air, or a combination of water and air.

10. The process of claim 1 further comprising selecting the pressure of air and/or water, or combination thereof, by way of a selector control valve, used to deliver a stain treating solution of user selective formulation.

11. The process of claim 1 further comprising selecting the dilution of a stain treating solution of user selective formulation with water and/or air under pressure.

12. The process of claim 1 further comprising selecting different stain treating solutions or a combination of stain treating solutions of user selective formulation with water and/or air under pressure.

* * * * *